United States Patent [19]

Hasegawa et al.

[11] 4,163,924

[45] Aug. 7, 1979

[54] CIRCUIT FOR TURNING ON A CHARGING-COMPLETION INDICATOR SEPARATE FROM A FLASH UNIT

[75] Inventors: Hiroshi Hasegawa, Tokyo; Tetsuro Goto, Funabashi, both of Japan

[73] Assignee: Nippon Kogaku K.K., Tokyo, Japan

[21] Appl. No.: 791,183

[22] Filed: Apr. 27, 1977

[30] Foreign Application Priority Data

Apr. 30, 1976 [JP] Japan ..... 51-53416[U]

[51] Int. Cl.[2] ..... H05B 41/32

[52] U.S. Cl. ..... 315/241 P; 315/133; 340/660; 354/127

[58] Field of Search ..... 315/133, 135, 136, 241 P, 315/130–132, 312; 320/1; 354/127, 128, 145, 53, 60 L; 340/660

[56] References Cited

U.S. PATENT DOCUMENTS 4,030,108 6/1977 Yazaki et al. ..... 354/145 X

FOREIGN PATENT DOCUMENTS 2434973 2/1975 Fed. Rep. of Germany ..... 354/128

*Primary Examiner*—Eugene R. LaRoche
*Attorney, Agent, or Firm*—Shapiro and Shapiro

[57] ABSTRACT

In a flash unit, wherein completion of the charging of a main capacitor from a DC-DC converter is indicated by a first indicator connected to the converter by a first voltage dividing circuit, there is provided a second voltage dividing circuit connected to the DC-DC converter and a switching circuit disposed between the second voltage dividing circuit and the first indicator so that an output voltage sufficient to energize a second (separate) indicator reliably is produced from the second voltage dividing circuit upon operation of the first indicator.

4 Claims, 1 Drawing Figure

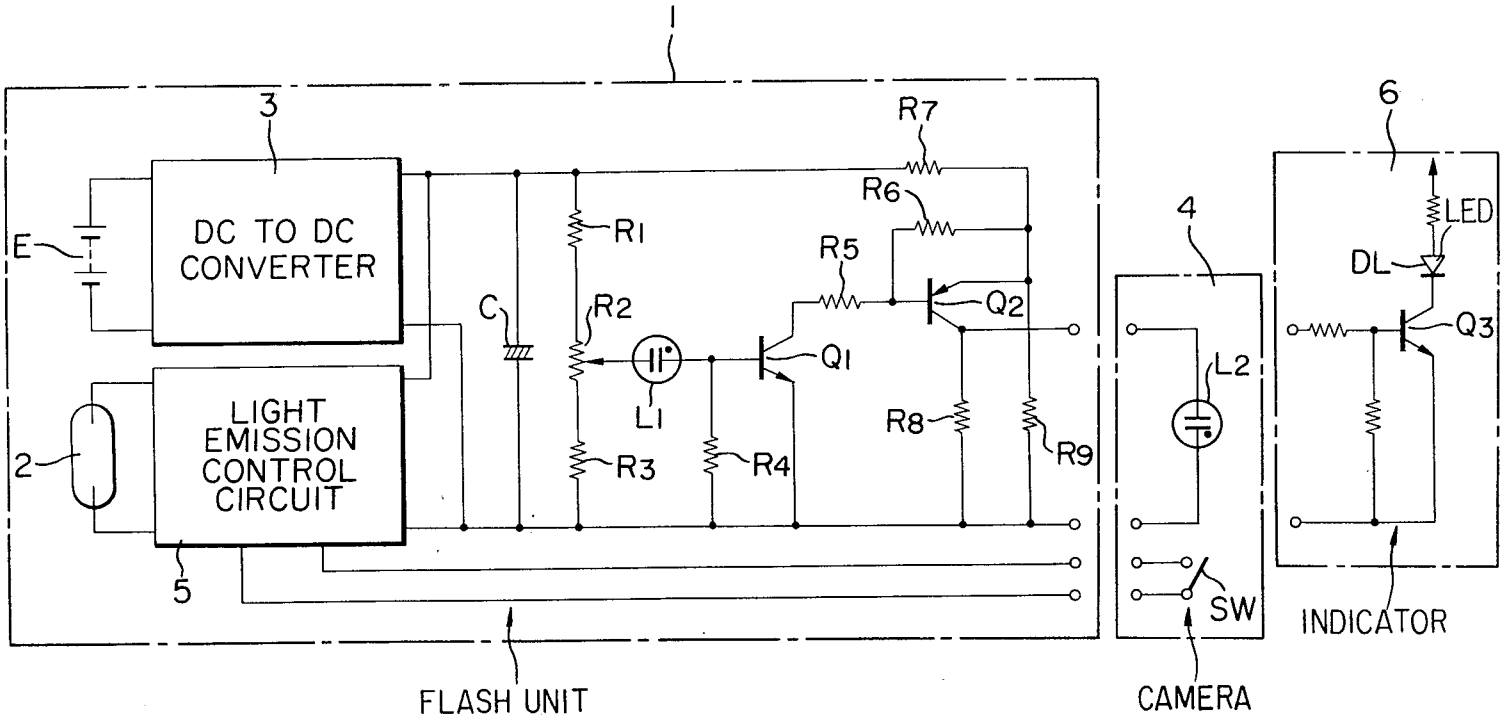
6
LED
DL
Q3
INDICATOR
4
L2
SW
CAMERA
1
R9
Q2
R7
R6
R8
R5
Q1
R4
L1
R1
R2
R3
C
FLASH UNIT
3
DC TO DC CONVERTER
LIGHT EMISSION CONTROL CIRCUIT
5
E
2

CIRCUIT FOR TURNING ON A CHARGING-COMPLETION INDICATOR SEPARATE FROM A FLASH UNIT

BACKGROUND OF THE INVENTION

1. Field of the Invention

This invention relates to flash photography, and more particularly to a circuit for reliably turning on a charging-completion indicator separate from the flash unit.

2. Description of the Prior Art

Conventionally, the energy for operating a flash discharge tube of an electronic flash unit has been stored in a main capacitor by means of a DC-DC converter. A voltage dividing circuit has been parallel-connected to the main capacitor, and when the charging voltage of the main capacitor has reached a predetermined value, an indicator has been turned on to indicate the completion of charging of the main capacitor. Another indicator has been conventionally provided on the camera, and when the camera and the flash unit have been connected together, this indicator has been connected to the aforementioned voltage dividing circuit in the flash unit to thereby enable the completion of charging to be indicated on the camera as well.

However, various types of indicator elements, such as neon lamps, light emitting diodes, etc., have been used on the flash unit and the camera and such devices may have different turn-on voltages. Accordingly, when different flash units are used with cameras or the like interchangeably, and vice versa, the different types of indicators in the flash unit and camera sometimes have failed to be turned on simultaneously.

Further, even when the same types of indicators, especially, neon lamps, are provided on the flash unit and the camera, it has not always been possible to choose indicators with the same turn-on voltage, because the turn-on voltage usually differs from one indicator to another. If the irregularity in turn-on voltage of neon lamps, for example, is corrected by parallel-connecting voltage dividing circuits to the respective neon lamps and by individually adjusting the voltage dividing ratios, the resulting circuit is troublesome to use and is uneconomical.

SUMMARY OF THE INVENTION

The present invention has for its principal object to eliminate the above-noted disadvantages and to provide a circuit for reliably turning on a charging-completion indicator separate from the flash unit.

According to the present invention, an output voltage high enough for reliable energization of a charging-completion indicator separate from an electronic flash unit is produced whenever the charging-completion indicator of the flash unit itself is energized.

The invention will become more fully apparent from the following detailed description thereof taken in conjunction with the drawing.

BRIEF DESCRIPTION OF THE DRAWING

The single FIGURE of the drawing is a circuit diagram showing a preferred embodiment of the present invention.

DESCRIPTION OF THE PREFERRED EMBODIMENT

In the electronic flash unit 1 of the drawing, the energy for causing a flash discharge tube 2 to emit light is stored in a main capacitor C by means of a DC-DC converter 3 supplied with power from a battery E. The flash discharge tube 2 is excited for light emission by a light emission control circuit 5 upon closing of the X-contacts SW of a camera 4.

When the charging voltage of the main capacitor C reaches a predetermined level, an indicator such as a neon lamp L1 is turned on by a voltage provided from a first voltage dividing circuit comprising resistors R1, R2, and R3, thereby indicating the completion of charging of the main capacitor C.

Upon turn-on of the neon lamp L1, a voltage is produced across a resistor R4 series-connected to the lamp L1, so that a first switching transistor Q1 becomes conductive to detect the turn-on of the neon lamp L1. A second switching transistor, Q2, which has so far been non-conductive, is thereby rendered conductive also. The emitter voltage of transistor Q2 is established by a second voltage dividing circuit comprising resistors R5–R9 for dividing the output voltage of the DC-DC converter 3. The emitter voltage of transistor Q2, derived at high impedance in the collector circuit of transistor Q2 when the transistor is conductive, is set by the second voltage dividing circuit such that it is substantially higher than the turn-on voltage of an ordinary neon lamp (about 70 V). Therefore, when the flash unit 1 is electrically connected to the camera and indicator L1 is energized, the collector voltage of transistor Q2 is applied to a second indictor, such as a neon lamp L2, in the camera 4, and the neon lamp L2 will be turned on reliably without requiring any adjustment.

When the flash unit 1 is not attached to the camera 4, the high impedance of the collector circuit of transistor Q2 eliminates the risk of significant electrical shock to the human body even if one inadvertently touches the indicator output terminal of the flash unit.

Designated by 6 is another indicator unit, which uses a light emitting diode (LED) as the indicator element. In this unit, a transistor Q3 is provided to detect the collector voltage of transistor Q2, and a light emitting diode DL is incorporated which is driven from a power source (not shown) within the camera. Again, when indicator L1 is energized, a voltage high enough to insure reliable operation of the LED is produced.

Thus, according to the present invention, it is possible, with different flash units used interchangeably with different cameras or the like, to insure proper operation of various types of semiconductor or other indicators separate from the flash units. Even when the charging-completion indicators are all of the same type, such as neon lamps, each indicator can be reliably turned on without the necessity of compensating for the differences between their turn-on voltages.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. In a flash unit wherein a main capacitor is charged from the output of a DC-DC converter to store the energy for causing a flash lamp to emit light, and wherein a first light-emitting element connected to the output of said converter by a voltage dividing circuit is energized when the capacitor voltage has reached a predetermined value, to indicate the completion of charging of the main capacitor, the improvement comprising:

a second voltage dividing circuit connected to the output of said DC-DC converter and operable to produce a high-impedance signal whose voltage is greater than the turn-on voltage of a second light-emitting element separate from said flash unit; and switching means for rendering said second voltage dividing circuit operative to produce said high-impedance signal upon energization of said first light-emitting element, said second voltage dividing circuit having a transistor with a base connected to said switching means and responsive thereto for rendering the transistor conductive, with an emitter connected to an intermediate point in said second voltage dividing circuit, and with a collector connected to said DC-DC converter through a collector resistor, the voltage of said high-impedance signal being derived between electrical connector elements connected to opposite ends of said collector resistor, respectively, the second voltage dividing circuit and the switching means being part of the flash unit and the second light-emitting element being part of a camera, the flash unit and the camera having cooperating electrical connector elements, including the aforesaid connector elements, that are connected when the flash unit is used with the camera, the impedance of the collector circuit of said transistor being high enough to prevent significant shock to the user of the flash unit who touches the connector elements between which said voltage is derived.

2. A flash unit according to claim 1, wherein the switching means comprises a transistor switch and the first light-emitting element is a neon lamp connected to the base of the transistor switch to operate the switch when the first light-emitting element is energized.

3. A flash unit according to claim 1, wherein the voltage of said high-impedance signal is substantially greater than 70 volts.

4. A flash unit according to claim 3, wherein the second light-emitting element is a neon lamp.

* * * * *